US008057627B2

(12) United States Patent
Herz et al.

(10) Patent No.: US 8,057,627 B2
(45) Date of Patent: Nov. 15, 2011

(54) TAPE APPLICATION METHOD AND TAPE APPLICATION DEVICE

(75) Inventors: Frank Herz, Friedberg (DE); Wolfgang Semmlinger, Augsburg (DE); Jürgen Liepert, Aindling (DE)

(73) Assignee: KUKA Systems GmbH, Augsburg (DE)

( * ) Notice: Subject to any disclaimer, the term of this patent is extended or adjusted under 35 U.S.C. 154(b) by 183 days.

(21) Appl. No.: 12/444,756

(22) PCT Filed: Mar. 6, 2008

(86) PCT No.: PCT/EP2008/001792

§ 371 (c)(1),
(2), (4) Date: Apr. 8, 2009

(87) PCT Pub. No.: WO2008/116548

PCT Pub. Date: Oct. 2, 2008

(65) Prior Publication Data

US 2009/0320997 A1 Dec. 31, 2009

(30) Foreign Application Priority Data

Mar. 11, 2007 (DE) ..... 20 2007 003 696 U

(51) Int. Cl.
*B32B 37/00* (2006.01)
*B32B 38/04* (2006.01)

(52) U.S. Cl. ..... 156/270; 156/152; 156/249; 156/256; 156/264; 156/265; 156/523; 156/577; 156/715; 156/759; 156/919; 156/931; 156/935

(58) Field of Classification Search ..... 156/523, 156/577, 249, 256, 264, 265, 270, 152, 715, 156/759, 919, 935, 931
See application file for complete search history.

(56) References Cited

U.S. PATENT DOCUMENTS

| | | | | |
|---|---|---|---|---|
| 4,882,007 | A * | 11/1989 | Lengen et al. | 156/523 |
| 6,187,128 | B1 * | 2/2001 | Oosterlinck | 156/249 |
| 2002/0189746 | A1 | 12/2002 | Kuta et al. | |

FOREIGN PATENT DOCUMENTS

| | | | |
|---|---|---|---|
| DE | 36 14 365 | C2 | 10/1987 |
| DE | 102 35 784 | A1 | 2/2004 |
| DE | 102 35 786 | A1 | 2/2004 |
| EP | 0 181 280 | A1 | 5/1986 |
| EP | 0 640 545 | A1 | 3/1995 |

* cited by examiner

*Primary Examiner* — Linda L Gray
(74) *Attorney, Agent, or Firm* — McGlew and Tuttle, P.C.

(57) ABSTRACT

A method and device (1) are provided for applying laminated tapes (2, 3) with an adhesive tape (2) and a cover tape (3) on a surface (4). The tape application device (1) includes a frame (5), a tape winder (8) for the laminated tape (2, 3), a tape winder (9) for the pulled-off cover tape (3), a tape guide (14) and a pressure-exerting device (18) for pressing the adhesive tape (2) onto a surface (4). During application, the cover tape (3) is at some parts detached and guided away from the adhesive tape (2), wherein the adhesive tape (2) can be severed at the detachment point and can be pressed onto the surface (4) with two closely adjacent pressing elements (19, 20).

30 Claims, 9 Drawing Sheets

TAPE APPLICATION METHOD AND TAPE APPLICATION DEVICE

CROSS REFERENCE TO RELATED APPLICATIONS

This application is a United States National Phase application of International Application PCT/EP2008/001792 and claims the benefit of priority under 35 U.S.C. §119 of German Patent Application DE 20 2007 003 696.5 filed Mar. 11, 2007, the entire contents of which are incorporated herein by reference.

FIELD OF THE INVENTION

The present invention pertains to a tape application method for applying at least an adhesive tape and a cover tape to a substrate and to a tape applicator for multilayer tapes having at least one adhesive tape and a cover tape, wherein the tape applicator has a frame, a tape roll for the multilayer tape, a tape guide for the pulled-off cover tape, a tape guide and a pressing device for pressing the adhesive tape onto a substrate.

BACKGROUND OF THE INVENTION

DE 102 35 784 A1 shows a tape applicator for multilayer tapes, which comprise a double-sided adhesive tape and a cover tape. The device has a frame, two tape rolls for the multilayer tape and the pulled-off cover tape as well as a tape guide and a pressing device for pressing the adhesive tape on a substrate. The pressing device has a single rotatable pad roll, which presses the multilayer tape against the substrate. The adhesive tape and the cover tape are separated from one another at the pressing site, and the cover tape is then led further to its tape roll.

SUMMARY OF THE INVENTION

The object of the present invention is to show an improved tape application technique for multilayer tapes.

The tape application technique according to the present invention has the advantage that it is suitable for all types of multilayer tapes. It is able to apply tape sections of any desired length and especially also very short tape sections to the substrate, which is not possible with the prior-art device.

A succession of pieces of tape can also be applied with the present invention in the manner of a stitch seam at any desired mutual distance and especially at very short mutual distances. The tape applicator being claimed is highly flexible in terms of the desired application pattern and has a very broad spectrum of use.

The cover tape can be separated from the adhesive tape in places and moved away. The adhesive tape exposed as a result can be cut at this site and brought to the desired length. This facilitates the cutting operation, which can, moreover, be carried out during the tape application. The cover tape can remain intact during the cutting operation and can be removed and disposed of more easily. On both sides of the separation and cutting site, the adhesive tape can be pressed with its front side onto the substrate and fixed accurately positioned and reliably for the application of the tape. The cover tape can lie on the adhesive tape at the pressing sites and prevent the reverse side of the adhesive tape from sticking in an undesired manner when pressing on.

A multiple arrangement, preferable a double arrangement, of pressing elements ensures improved, highly reliable and gentle pressing and connection of the adhesive tape to the substrate. The tape applicator is fast, reliable in operation and highly economical as a result. This arrangement does, moreover, offer further advantages.

The cover tape can be separated from the adhesive tape between the pressing elements and led in a loop. This offers, on the one hand, the possibility of acting on the exposed section of adhesive tape being held between the pressing elements with a cutting means in the open loop area. As a result, it is possible to cut through the adhesive tape only and the cover tape can remain undamaged. By holding and cutting the section of adhesive tape in a floating manner, the cutting means does not come into undesired contact with the substrate. Tapes can also be applied mechanically to a mechanically sensitive substrate due to the gentle technique. Such a cutting technique is, in addition, favorable for cutting the adhesive tape to an exact, specific length and the possible intermittent application of short sections of adhesive tape.

The cutting means may have one or more cutting members, which can be adapted to different properties of tapes. A cutting knife with upright blade and in the form of a drawing knife is suitable for harder and dimensionally more stable types of tapes. A rotating cutting knife may be better suited for softer and more labile types of tapes. The cutting member can be moved to and fro between a working position and an inoperative position by means of a feeding means.

On the other hand, the adhesive tape is again led through under the second pressing element that is the rear pressing element in the direction of feed at the exit of the loop and is now located between the pressing element and the adhesive tape. This avoids a direct contact between the pressing element and the adhesive tape, which is advantageous in various respects. On the one hand, transfer of adhesive to the pressing element is avoided during the use of adhesive tapes. On the other hand, adhesive tapes may also have a surface that is reactive in another way, which remains covered with the inert cover tape when being pressed under both pressing elements and does not come into a possibly damaging contact with the pressing elements.

Furthermore, it is favorable for an exact, specific cutting if a fixing means for the cover tape is arranged in the area of the loop, which fixing means prevents the multilayer tape from being transported further after cutting. The residual path for pressing the cut-off adhesive tape can be compensated by a compensating device in the area of the loop. The compensation motion of this compensating device can be subsequently returned when the application operation is resumed.

The tape application technique being claimed is suitable for all types of multilayer tapes. The adhesive tape may be pressure sensitive and have one or two adhesive surfaces. On the other hand, it may also form another kind of bonded connection with the substrate by, e.g., an adhesive surface or another sticky surface being arranged there, onto which said tape is pressed and then sticks to it. A bonded connection may take place mechanically in the manner of a Velcro closure or the like.

The tape application technique being claimed ensures reliable separation of the adhesive tape from the cover tape and exactly defined application of the adhesive tape over the desired length. The adhesive tape is spared to the extent possible and is nevertheless connected in the desired manner to the substrate with sufficient reliability. In particular, it is favorable if the cut-off end of the adhesive tape is pressed on and fixed additionally by the rear pressing element, for example, a freely rotatable roller.

Due to its high reliability of operation, the tape applicator being claimed is also suitable for automatic operation and in conjunction with a manipulator, e.g., a multiaxial robot. On the one hand, the alignment and feeding of the tape applicator in relation to the substrate can be checked and monitored by means of a corresponding sensor system. On the other hand, the process can be monitored and checked, e.g., for splicing errors, tape break or the like.

In addition, the tape applicator handles the multilayer tape especially gently. The tape can be pulled off from the first tape roll by pressing forces and the clamping at the application site on the substrate.

The tape tension depends automatically on the velocity of feed of the device. It is sufficient to provide a separate drive for the tape roll of the cover tape only. This drive may be equipped with a tensioning device arranged upstream of the tape roll, e.g., a dancer roll, which also controls the drive. Cooperation with the fixing means and with the compensation means is automatically possible as a result in such a way as to ensure a proper process. The drive is also switched on again in a self-regulating manner when the tape application operation is resumed.

In addition, the present invention also makes it possible for the adhesive tape applied to the substrate to adapt or assume a shape. A molding or form roller array may be provided for this. Adaptation to any desired contour is possible by a suitable arrangement and design of moldings, especially freely rotatable form rollers.

The cover tape can be returned to the adhesive tape already deposited in the area of the form roller array as well and applied temporarily here. The cover tape can again the separated from the deposited adhesive tape and returned to the cover tape roll after adaptation to the shape by means of yet another downstream pressing element, especially a freely rotatable pressing roller. In addition, the deposited adhesive tape can be additionally pressed once again onto the substrate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
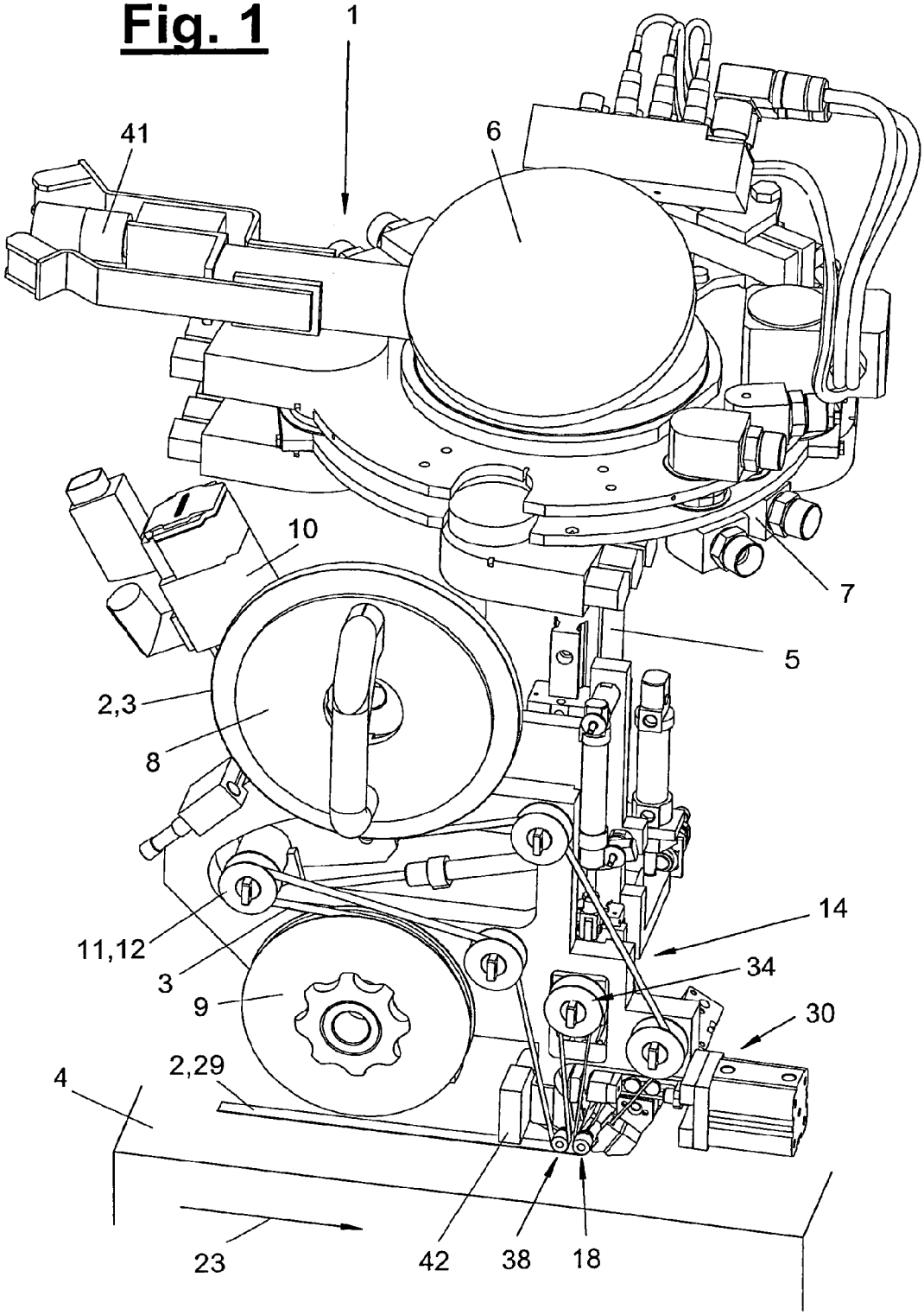
FIG. 1 is a perspective front view of the tape applicator.
Figure 2:
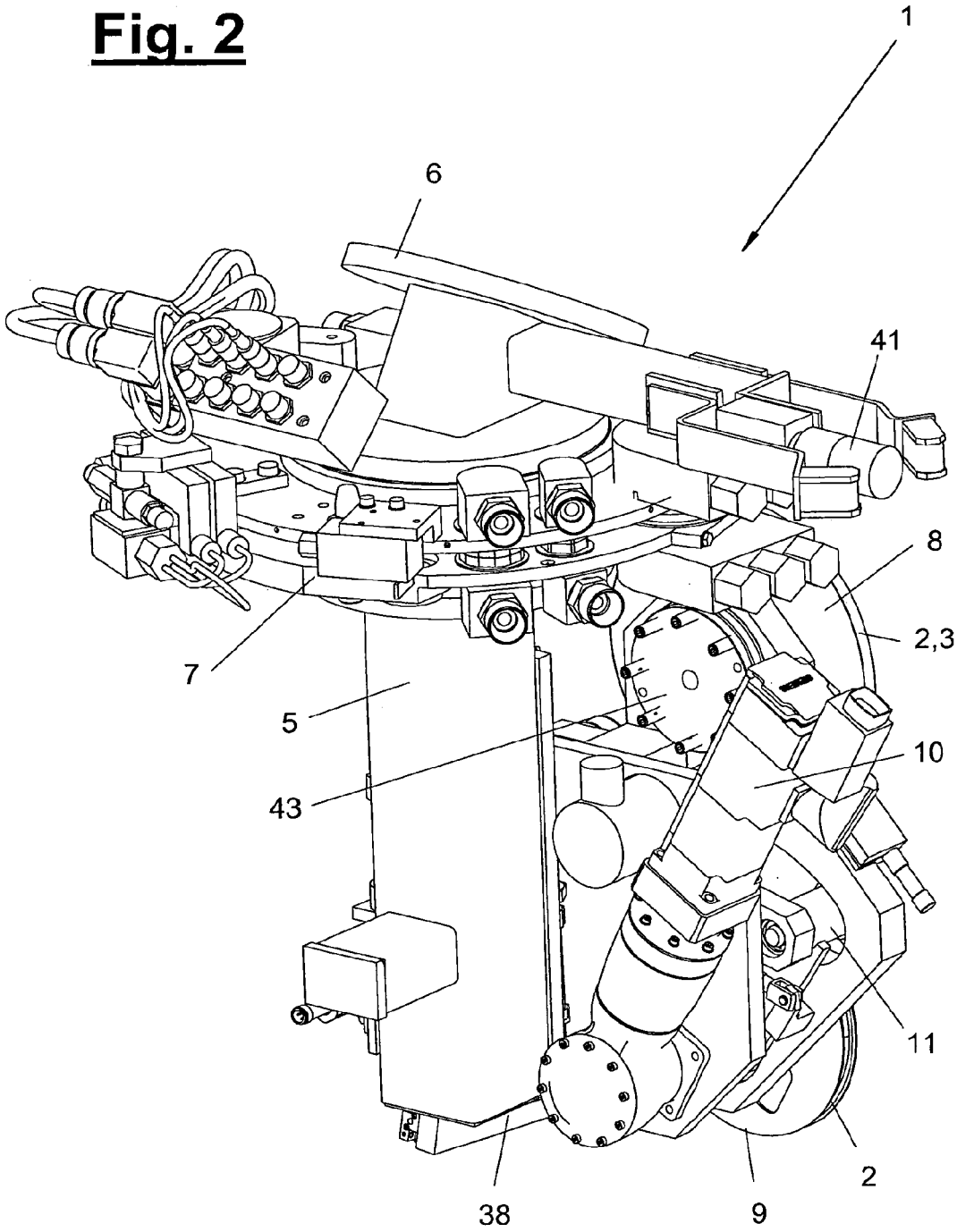
FIG. 2 is a perspective rear view of the tape applicator from FIG. 1.

Referring to the drawings in particular, the present invention pertains to an applicator (1) for multilayer tapes (2, 3) along with an operating method. Such a tape applicator (1) is shown in two variants, for example, in the drawings in FIGS. 1 through 10.

The multilayer tapes (2, 3) to be applied may be of different types and designs. In the embodiment being shown, they comprise two layers, which are formed by an adhesive tape (2) and a cover tape (3). The number of layers may be alternatively greater. In particular, the adhesive tape (2) may comprise a plurality of layers. The adhesive tape (2) may have various designs. It is a double-sided adhesive tape in the exemplary embodiment being shown. As an alternative, the adhesive tape (2) may have an adhesive surface on one side only and a reactive surface, e.g., a material layer reacting to pressure, heat or other effects on the other side. The second side may also be formed by a foam or any other material, which is protected by the cover tape (3).

The adhesive tape (2) does not have to be adhesive by itself. An adhesive tape (2) is defined in the sense of the present invention as any kind of tape that adheres to a substrate (4) after application in any way or acquires any other reference in terms of position to the substrate (4). The adhesive action may originate on one side from the substrate (4) or on both sides from the substrate (4) and the adhesive tape (2). The adhesive effect can be achieved in any desired manner, e.g., by an adhesive connection, by adhesion, by clinging together mechanically or interlinking or the like. The cover tape (3) consists of e.g., an inert material and is designed as a silicone tape or the like in the exemplary embodiment being shown. The cover tape (3) has a weaker adhesive force to the adhesive tape (2) than the substrate (4) in adhesive tapes (2) that adhere on both sides.

The cover tape (3) can be separated from the adhesive tape (2) in places during the application of the tape and led away. The exposed adhesive tape (2) can be cut through without damaging the cover tape (3) at this point. Both tapes can be pressed by a pressing device (18) onto the substrate (4) on both sides of the separation and cutting site.

FIGS. 1 through 6 show a first variant of the tape applicator (1). It comprises a frame (5), at which at least two tape rolls (8, 9) having parallel axes are arranged rotatably and detachably. The upper tape roll (8) is intended for the still connected multilayer tape (2, 3). The lower tape roll (9) is used to take up the cover tape (3) separated from the adhesive tape (2). Any other types of tape reserves or take pick-ups may be used instead of the rotatable tape rolls (8, 9).

The upper tape roll (8) for the multilayer tape (2, 3) is mounted freely rotatably and its unwinding motion is decelerated with a sliding clutch (43) or another construction. As a result, the multilayer tape (2, 3) can be pulled off in a controlled manner and under a steady pull. The lower tape roll (9) for the cover tape (3) has a drive (10) of its own and an upstream dancer (11). A dancer roll (12), over which the cover tape (3) is guided, is arranged at the arm of the dancer (11). The dancer roll arm is mounted at the frame (5) in such a way that it can perform rotary motion and is provided with an elastic adjusting element (13). The tape loop led around the dancer roll (12) is tensioned as a result and tightened. The adjusting element (13) may be, e.g., a mechanical spring or the pneumatically spring-mounted cylinder shown in the exemplary embodiment.

The dancer (11) can control the drive (10) and can turn it on or off depending on the cover tape tension exerted. For this, end stops, position indicators or other such means are present, which pick up the rotary position of the roll arm and impact the drive control in a corresponding manner.

The tape applicator (1) has, furthermore, a tape guide (14) with a plurality of deflecting rollers (15, 15', 16) as well as a guide shoe (17) for guiding the multilayer tape (2, 3) and the separated cover tape (3). Furthermore, a pressing device (18) for pressing the adhesive tape (2) onto a substrate (4) is provided on the underside. The tape applicator (1) contains, furthermore, a cutting means (38) and a compensating means (34) for the separated cover tape (3).

The tape applicator (1) may be connected to a guide means, e.g., a multiaxial manipulator, especially a multiaxial robot. The tape applicator (1) is positioned on the substrate (4) via the guide means, pressed onto same, and moved in the direction of feed (23). The tape applicator (1) has a connection (6) for connection to the guide means on the top side or at another suitable point. This may be a robot connection for connection to the multiaxially rotatable robot hand of an articulated arm robot in the exemplary embodiment being shown. Connection (6) may optionally also be connected directly and firmly to the frame (5) or detachably via the change-over clutch (7) shown in the exemplary embodiments. The robot can as a result couple and uncouple the tape applicator (1) as needed and also be replaced with another tool.

A sensor system may be present for guiding and positioning the tape applicator (1). This has, e.g., one or more sensors (41), which are designed, e.g., as a camera and are used to position and reference the tape applicator (1). Such a sensor (41) is shown at the connection (6) in FIG. 1. The tape applicator (1) may have, furthermore, one or more additional sensors (42) for monitoring the process. This is, e.g., the sensor shown in FIGS. 1 and 3 next to the pressing device (18), which is used, for example, to recognize splicing and as a tape break checker. It is directed towards the adhesive tape section (29) placed on the substrate (4).

The pressing device (18) is shown in FIGS. 3 through 6 in greater detail and in an enlarged form. As is illustrated in FIG. 1, the tape applicator (1) is moved by the guide means in the direction of feed (23). The pressing device (18) has at least two pressing elements (19, 20), which are located at closely spaced locations from one another and which may have any desired and suitable design and are designed, e.g., as freely rotatable cylindrical pressing rollers. The pressing rollers (19, 20) have a relatively small diameter of, e.g., 10 mm to 15 mm. The pressing elements (19, 20) are arranged one behind the other in the direction of feed (23) and both contact the cover tape (3). They act on the adhesive tape (2) via the cover tape (3) located in-between. The small diameter and the short distance of the pressing elements (19, 20) facilitate the application of very short adhesive tape sections (29), which may have, e.g., a length of about 30 mm.

The pressing element (19) located in front in the direction of feed (23) has an adjusting means (21) for lifting off from the substrate (4). The lifting off of the pressing element (19) may take place vertically or in the manner shown obliquely upwardly, and the pressing element (19) is removed from the other, rear pressing element (20) and is also spaced apart in the direction of feed (23). The adjusting means (21) may have any desired design. It has, e.g., an adjusting carriage (22) with a suitable drive, which said carriage is mounted such that it can move obliquely upwardly.

Figure 6:
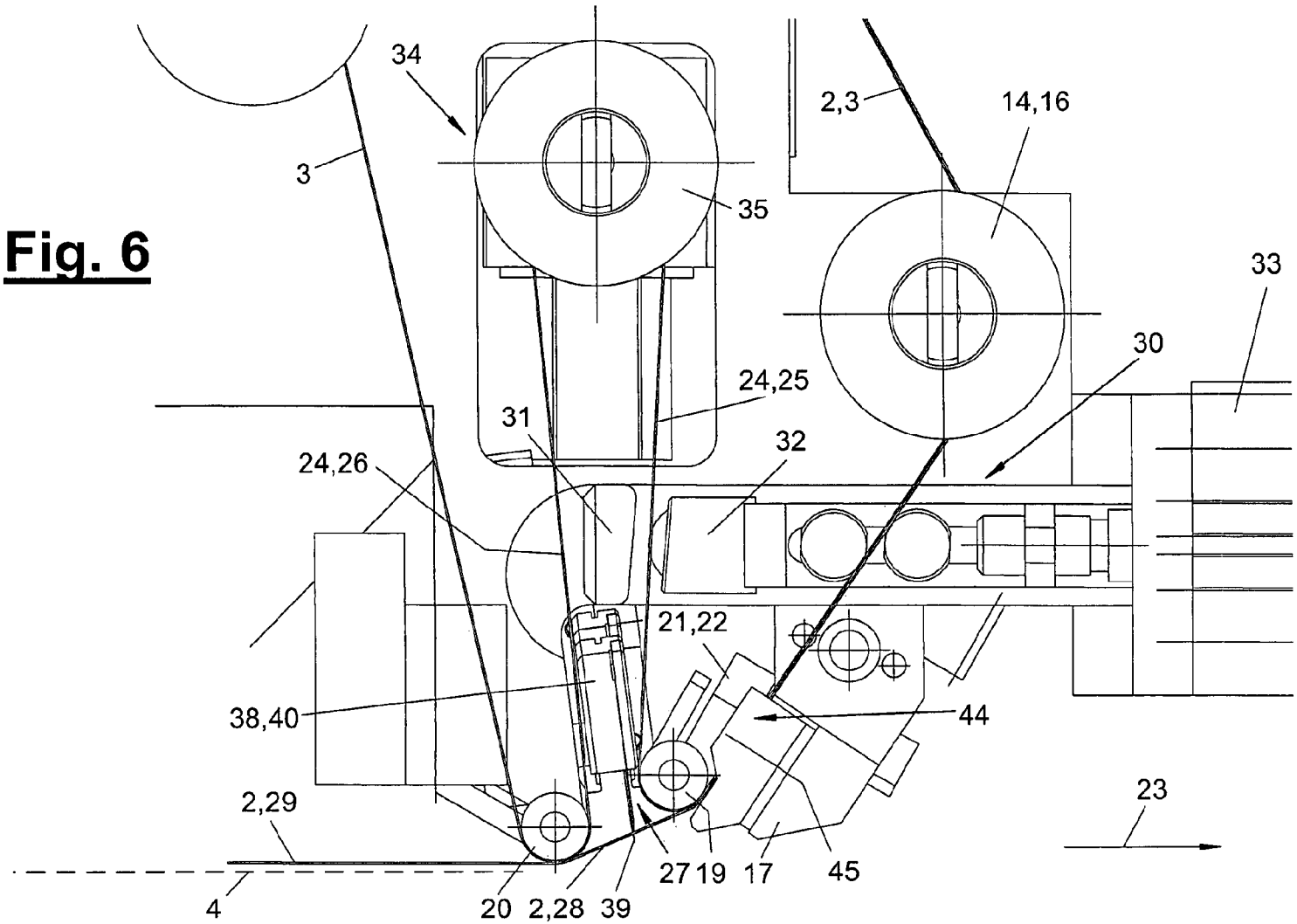
FIG. 6 is an enlarged front view of the pressing area.

For guiding the multilayer tape (2, 3), the guide means (14) has a freely rotatable deflecting roller (16) arranged in front of the front pressing element (19) and a guide shoe (17). Guide shoe 17 is arranged directly in front of the front pressing element (19) and guides the multilayer tape (2, 3) directly to the pressing element (19) with an upwardly open guide groove. Guide shoe (17) is directed obliquely and its inclination corresponds to the direction of feed of the multilayer tape (2, 3) and possibly also to the direction of adjustment of the front pressing element (19). In the position raised in the direction of feed (23), guide element (19) lies on a front guiding surface of the guide shoe (17) or is located adjacent at a closely spaced location there. FIG. 6 shows this arrangement.

Figure 4:
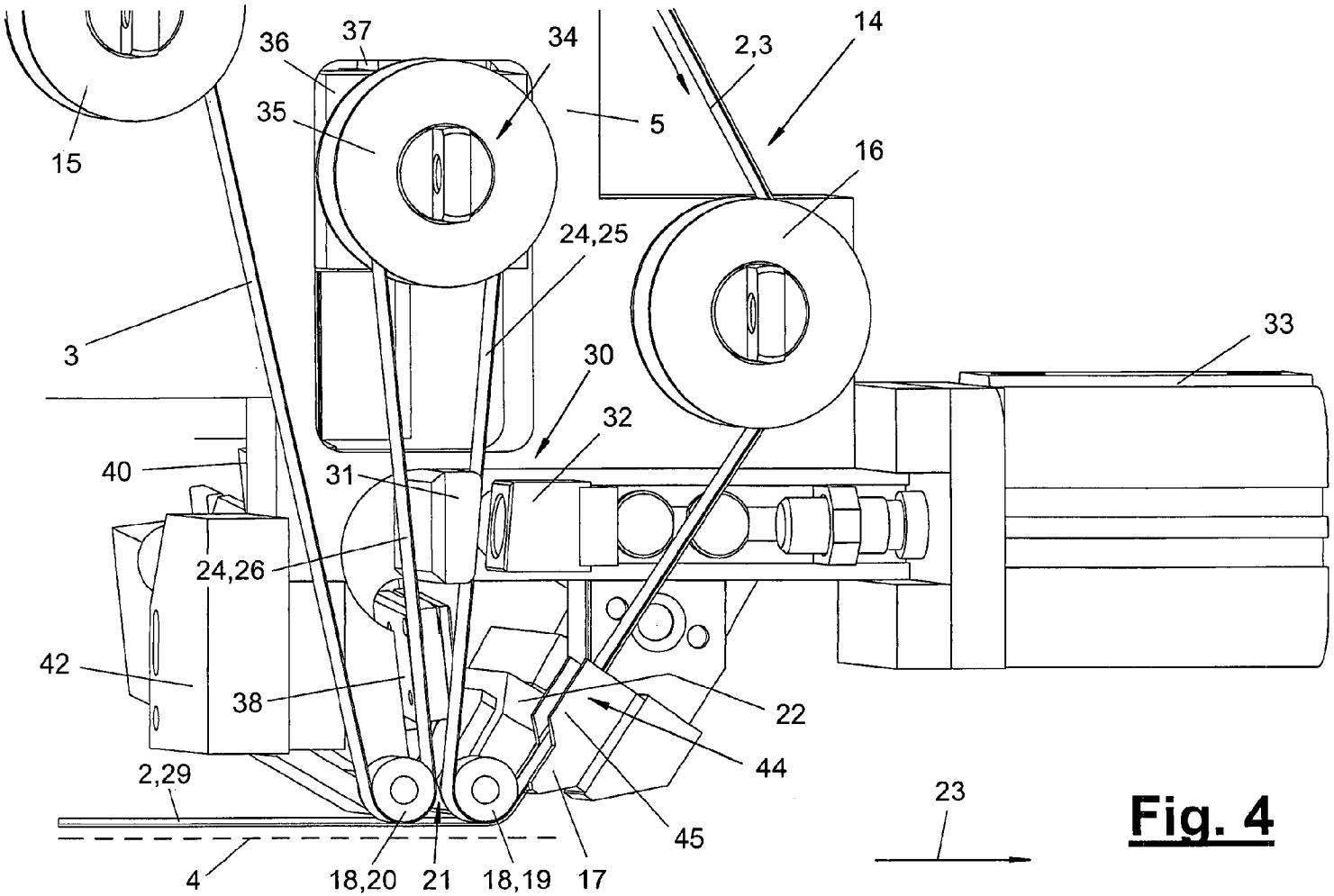
FIG. 4 is an enlarged view of the area in FIG. 3 from another angle of view.
Figure 5:
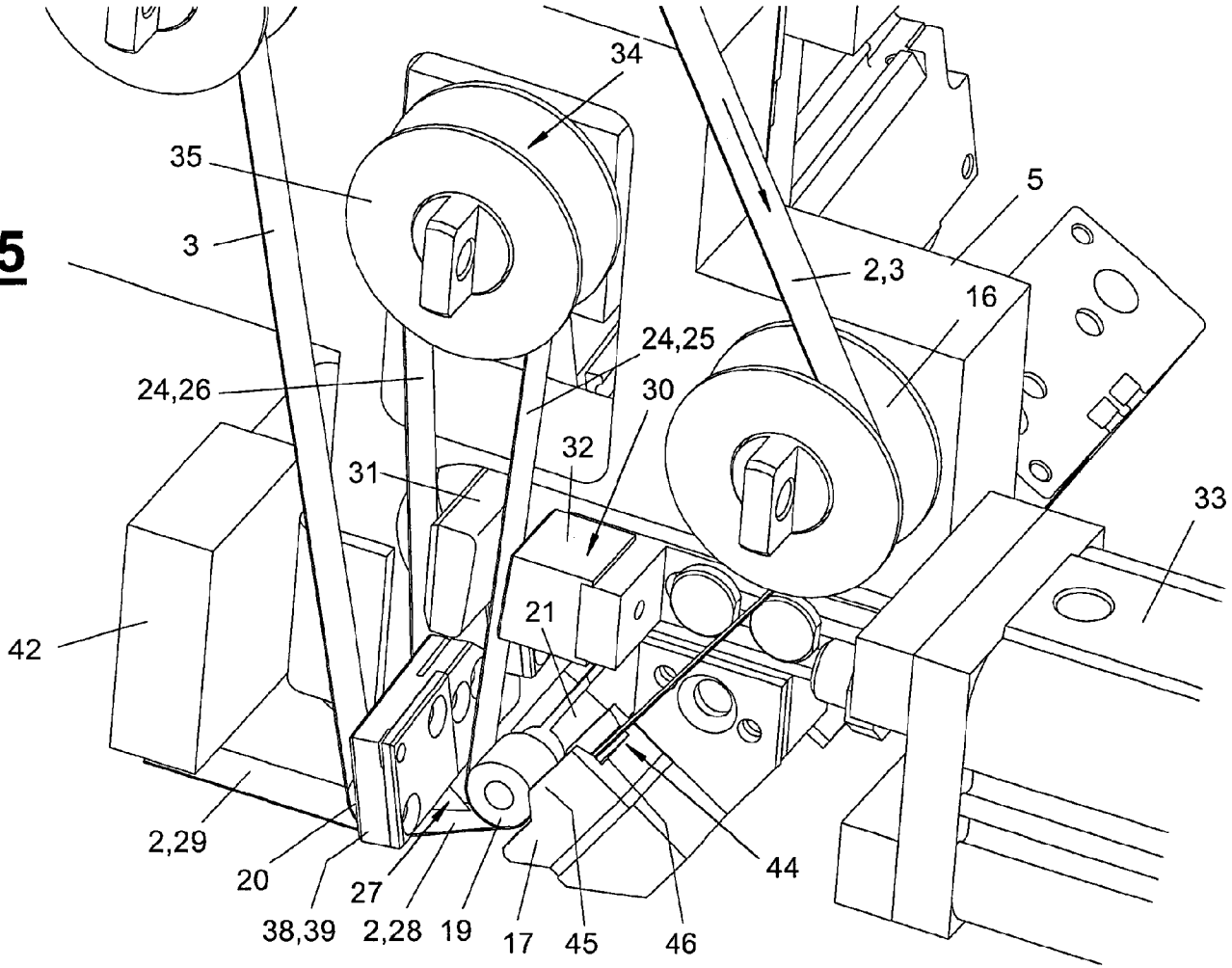
FIG. 5 is an even more enlarged perspective view of the pressing area.

The guide roller (16) arranged upstream may have a slightly conical jacket shape, which flares towards the frame (5) and introduces as a result the multilayer tape (2, 3) into the U-shaped guide shoe (17) with a defined reference edge. As is illustrated in FIG. 5, guide shoe (17) has, at the upper end, a guide groove (44) of an essentially U-shaped cross section, which has two upwardly projecting side walls with intake bevels and a groove bottom (46). The side wall (45) located on the left and on the outside in the direction of travel of the tape forms, e.g., the guide edge, at which the multilayer tape (2, 3) arrives in a floating manner and which defines the lateral position of the tape (2, 3) under the pressing element (19) and on the substrate (4). The side walls may end in front of the lower end of the guide shoe, e.g., approximately in the middle of the shoe, and the groove bottom (46) extends up to the lower end. FIG. 4 shows this arrangement in the operating position and in the pressed position.

Figure 3:
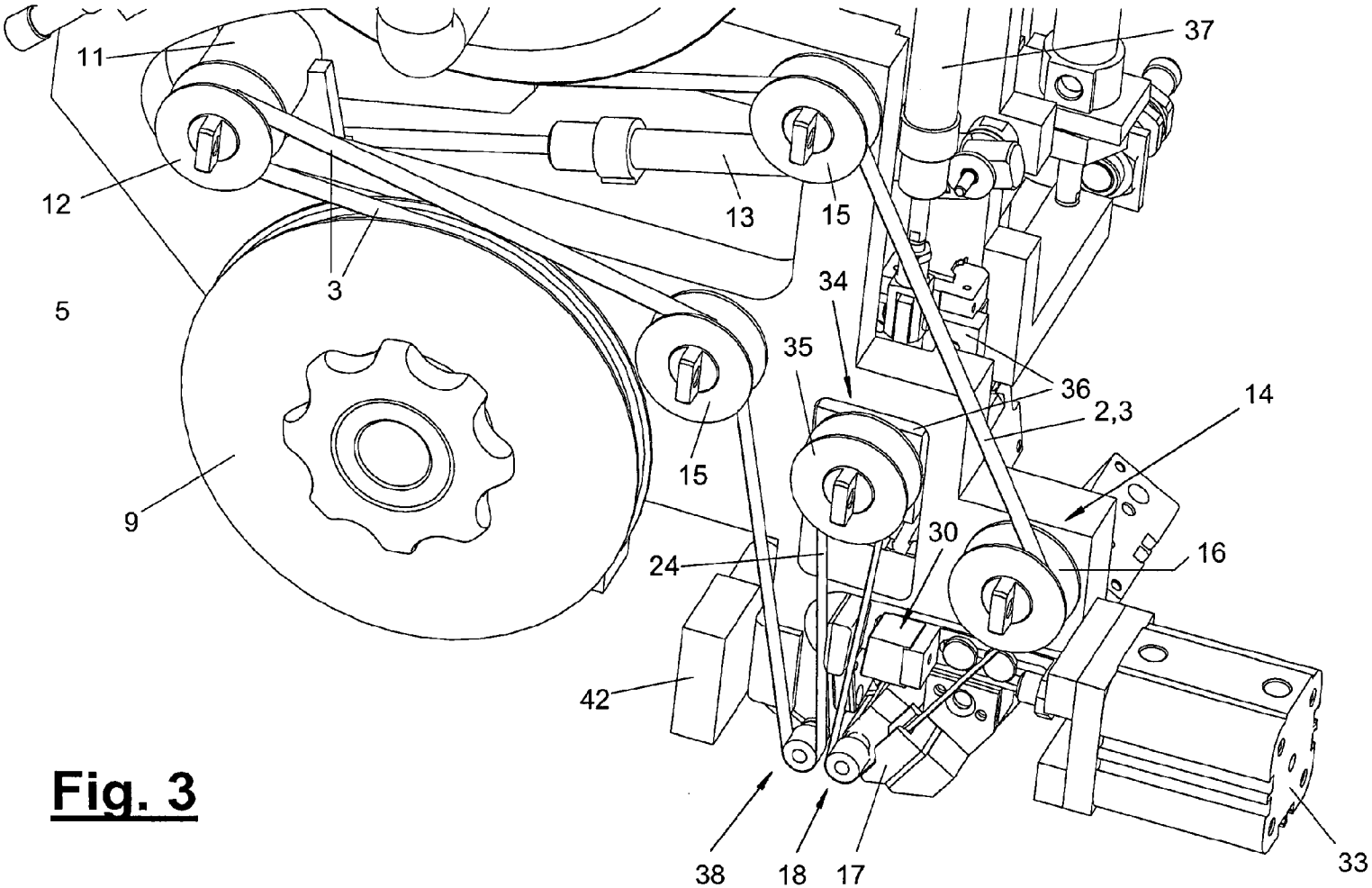
FIG. 3 is an enlarged perspective view of the tape applicator from FIG. 1 in a pressing area.

Both pressing elements (19, 20) press the multilayer tape (2, 3) under the action of the guide means against the substrate (4) in the operating position shown in FIGS. 1, 3 and 4. The cover tape (3) with its back is now in contact with the two pressing elements (19, 20). The adhesive tape (2) is exposed downwardly with its front side and can be pressed onto the substrate (4).

The cover tape (3) is separated from the adhesive tape (2) between the pressing elements (19, 20) and led in a tape loop (24). The tape loop (24) can expand towards the closed end and have a funnel shape as a result. The tape loop (24) may extend, e.g., in a straight line from the substrate (4) at right angles or obliquely upwardly. As an alternative, it may have a kinked or bent shape.

The compensating means (34) has a compensating element (35) able to yield at the closed end of the loop. The tape loop (24) can be led taut as a result and reduced if needed. The compensating element (35) may have any desired and suitable design and comprises, e.g., a freely rotatably mounted compensating roller. The compensating means (34) has, furthermore, a guide (36), which extends essentially in the longitudinal direction of the tape loop (24) and has, e.g., a guide rail with a carriage mounted movably thereon. The compensating means (34) has, furthermore, an elastic adjusting element (37) for the compensating element (35). This may be, e.g., a mechanical spring or the pneumatically spring-mounted cylinder shown in the drawings. As a result, the compensating element (35) is pulled upward and the tape loop (24) is tightened.

The cover tape (3) is led around the pressing element (20) located in the rear in the direction of feed (23) at the outlet of the loop (24) and as a result it again comes into contact with the reverse side of the adhesive tape (2), lying between the adhesive tape (2) and the pressing element (20). The adhesive tape section (29), which is already lying on the substrate (4) and is pressed on for the first time by the front pressing element (19), is pressed on firmly once again by the pressing element (20) during normal application operation and thus secures the bonded connection. The cover tape (3) is subsequently separated again from the deposited adhesive tape section (29) after the rear pressing element (20) has run over it and is led further to the dancer (11) and to the tape roll (9) via a freely rotatable deflecting roller (15).

A cutting device (38), which preferably acts on the adhesive tape (2) at the separation site and on the adhesive tape (2) only and which leaves the cover tape (3) undamaged, is provided. The cutting means (38) is arranged between the pressing elements (19, 20). The tape loop (24) is open downwardly and the cutting means (38) acts on the adhesive tape section (28) being held between the pressing elements (19, 20) in the area of this tape loop opening (27). The cutting means (38) has a cutting member (39, 39') and a drive (40) for feeding and returning the cutting member (39, 39').

The cutting member (39, 39') may have any desired and suitable design. In the variant according to FIGS. 1 through 6, the cutting member (39) is designed as a cutting knife with upright blade, which can be moved to and fro by the drive (40) and which preferably performs a drawing cut. Such a drawing knife (39) is especially suitable for hard and dimensionally more stable tape materials.

During the normal application operation with the pressing elements (19, 20) located at closely spaced locations from one another and at equal height, the cutting member (39) is pulled back to the rear and is located outside the tape loop (24). FIG. 4 shows this arrangement. The cutting function is illustrated in FIGS. 5 and 6 with the cutting member (39) fed forward. The front pressing element (19) is lifted off vertically or obliquely upwardly in this case, as a result of which the adhesive tape section (28) extends obliquely upwardly away from the substrate (4) between the pressing elements (19, 20) and is tightened. The tape loop opening (27) is also enlarged by the adjusting motion and space is created for the cutting member (39), which is fed, e.g., in the straight direction and cuts through the floating adhesive tape section (28) in this position. The adhesive tape section (28) is supported now at the guide shoe (17) and the guiding side wall (45) thereof. During the further motion of the tape applicator (1), the rear pressing element (20) securely presses the tape end cut off onto the substrate (4) and runs over it. The substrate (4) is indicated by broken line in FIG. 6.

It is favorable for the cutting process if the further conveying of the multilayer tape (2, 3) and especially of the adhesive tape (2) located there is temporarily stopped after the adhesive tape section (28) has been cut through. The tape applicator (1) has a fixing means (30) for this purpose for the separated cover tape (3) in the area of the tape loop (24). The fixing means (30) acts on the center (25) of the loop running from the front pressing element (19) to the compensating means (34) and fixes same. The fixing means (30) may be designed, e.g., as a controllable clamping means and has a pressure pad (31), which is a rigid part of the frame, and a clamping element (32), which can be fed by a drive (33) against the center (25) of the loop.

The multilayer tape (2, 3) is prevented by the fixed center (25) of the loop from being pulled by the upper tape roll (8). On the other hand, the rest of the feed motion can still take place for pressing on the adhesive tape end cut off thanks to the compensating means (34), and the cover tape (3) is rolled off by a certain amount around the rear pressing element (20). The tape length in question can be taken from the other loop center (26) running off, and the compensating element (35) yields for correspondingly shortening the loop length and moves downwards.

This adjusting motion of the tape loop (24) is limited. Due to the drive (10) of the cover tape roll (9) continuing to run, the dancer (11) is increasingly tightened via its tape loop because of this limitation until it reaches a switch-off position for the drive (10).

The raised front pressing element (19) is again moved by the adjusting means (21) downwards into the normal pressing position for a repeated tape application, and the freely hanging end of the adhesive tape section (28) is pressed onto the substrate. Due to the multilayer tape (2, 3) being clamped between the pressing element (19) and the substrate (4), the multilayer tape (2, 3) is tightened during the feed motion beginning thereafter and the cover tape (3) is also moved as a result through the tape loop (24) and further to the tape roll (9). The compensating means (34) and the dancer (11) are relaxed hereby and return into their starting positions. Drive (10) is then switched on again automatically for the cover tape roll (9) via the motion of the dancer roll. The adhesive tape section (28) separated from the cover tape (3) under the loop opening (27) is held at the substrate (4) between the pressing elements (19, 20) located at the same level and run over twice and pressed on by the pressing elements (19, 20).

Figure 7:
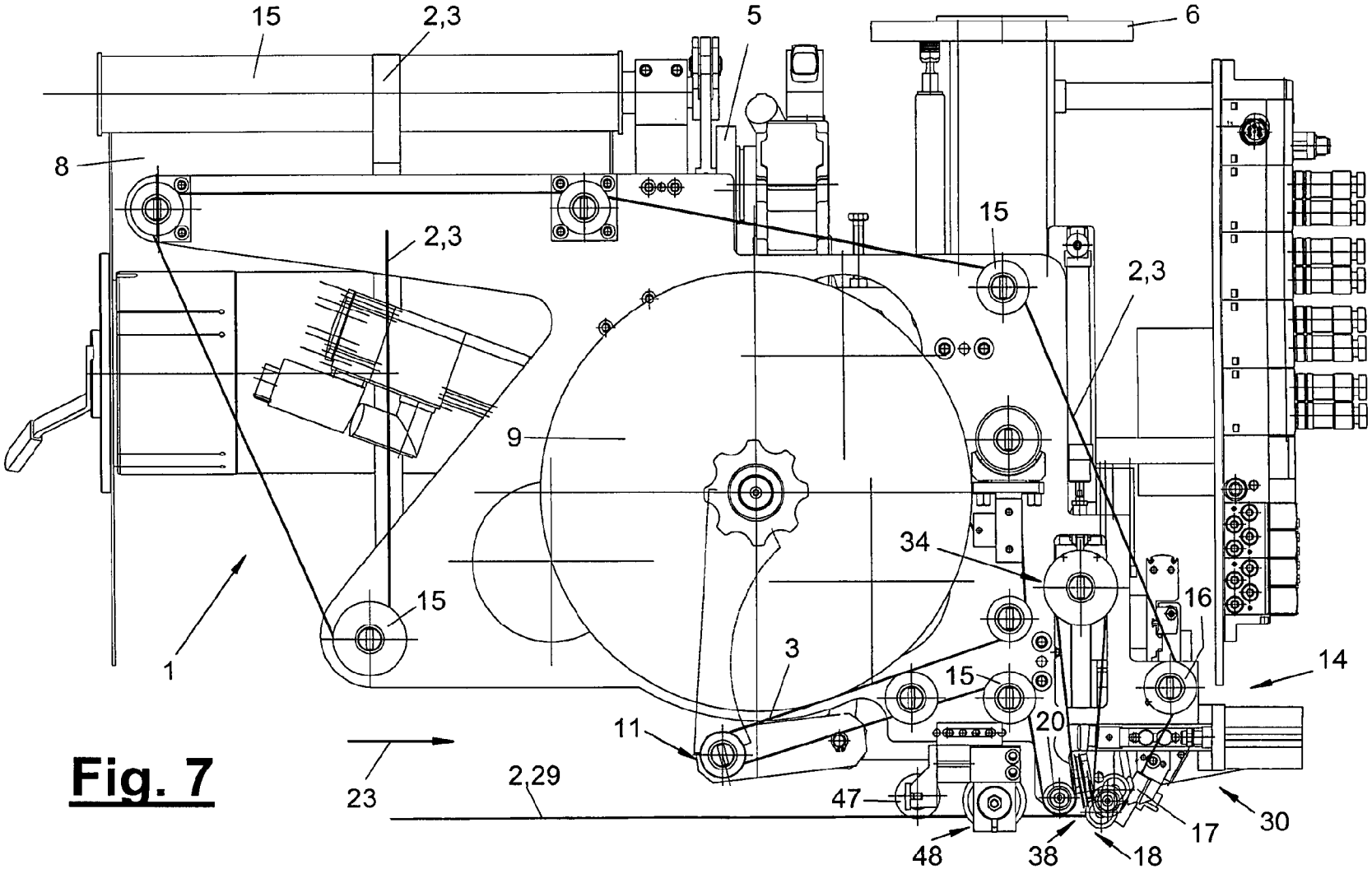
FIG. 7 is a variant of the tape applicator in a cut-away front view.

FIGS. 7 through 10 show a second variant of the tape-pressing device (1). This has, as in the first variant, a frame (5) and a connection (6) for connection to a robot. The tape roll (8) for the multilayer tape (2, 3) is offset laterally and is arranged rotated in relation to the tape roll (9) for the cover tape (3), the tape rolls (8, 9) having, e.g., axes of rotation arranged at right angles to one another. As is illustrated in FIG. 7, the multilayer tape (2, 3) arriving from the tape roll (8) is rotated by 90° and led over deflecting rollers (15, 16) to the pressing area. The tape guide (14) with the pressing means (18) and with the fixing means (30) as well as with the compensating means (34) has the same or similar design as in the first exemplary embodiment. The tape pressing device (1) does, however, have a different tape guide for the cover tape (3) after separation from the adhesive tape (2) in the second variant. In addition, the tape applicator (1) may have at least one additional pressing element (47) and a form roller body or form roller arrangement (48) in the second variant. In addition, the separating means (38) has a different design in the second embodiment.

There are two different embodiments for the guiding of the cover tape (3) in the second embodiment of the tape applicator (1). In the first variant according to FIG. 7, the cover tape (3) is led upward to a deflecting roller (15) and from here further to a dancer (11) after running around the rear pressing element (20). This type of tape guiding can be selected when the pressing element (47) and the form roller arrangement (48) are deactivated or removed.

Figure 8:
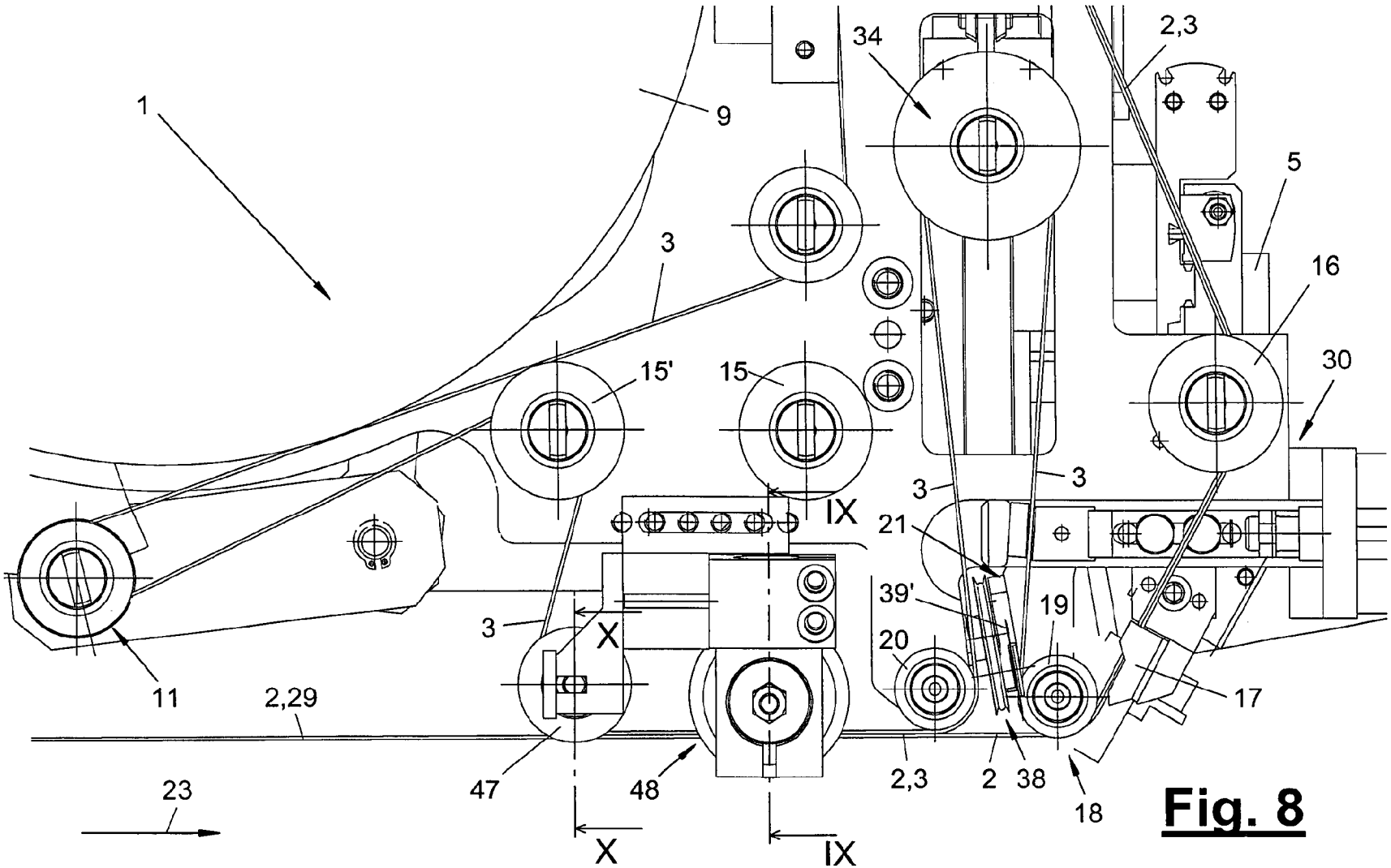
FIG. 8 is an enlarged detail of the pressing-on area of FIG. 7 with a modified tape guide.
Figure 10:
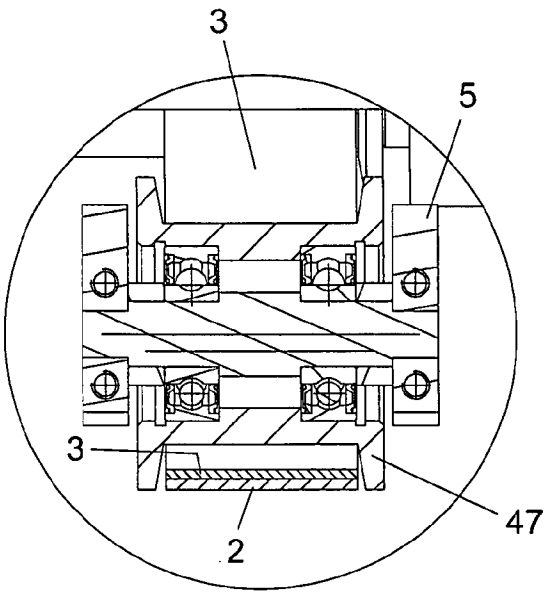
FIG. 10 is a section through a pressing roller according to section line X-X from FIG. 8.

In the second embodiment according to FIG. 8, the pressing element (47) and the form roller arrangement (48) are in the operating position. The cover tape (3) returned by the pressing element (20) remains on the reverse side of the adhesive tape section (29) deposited on the substrate (4) in this case and covers it upwardly. The molding arrangement (48) following in the direction of feed (23) contacts both tapes (2, 3) as a result and acts in the manner explained below.

Figure 9:
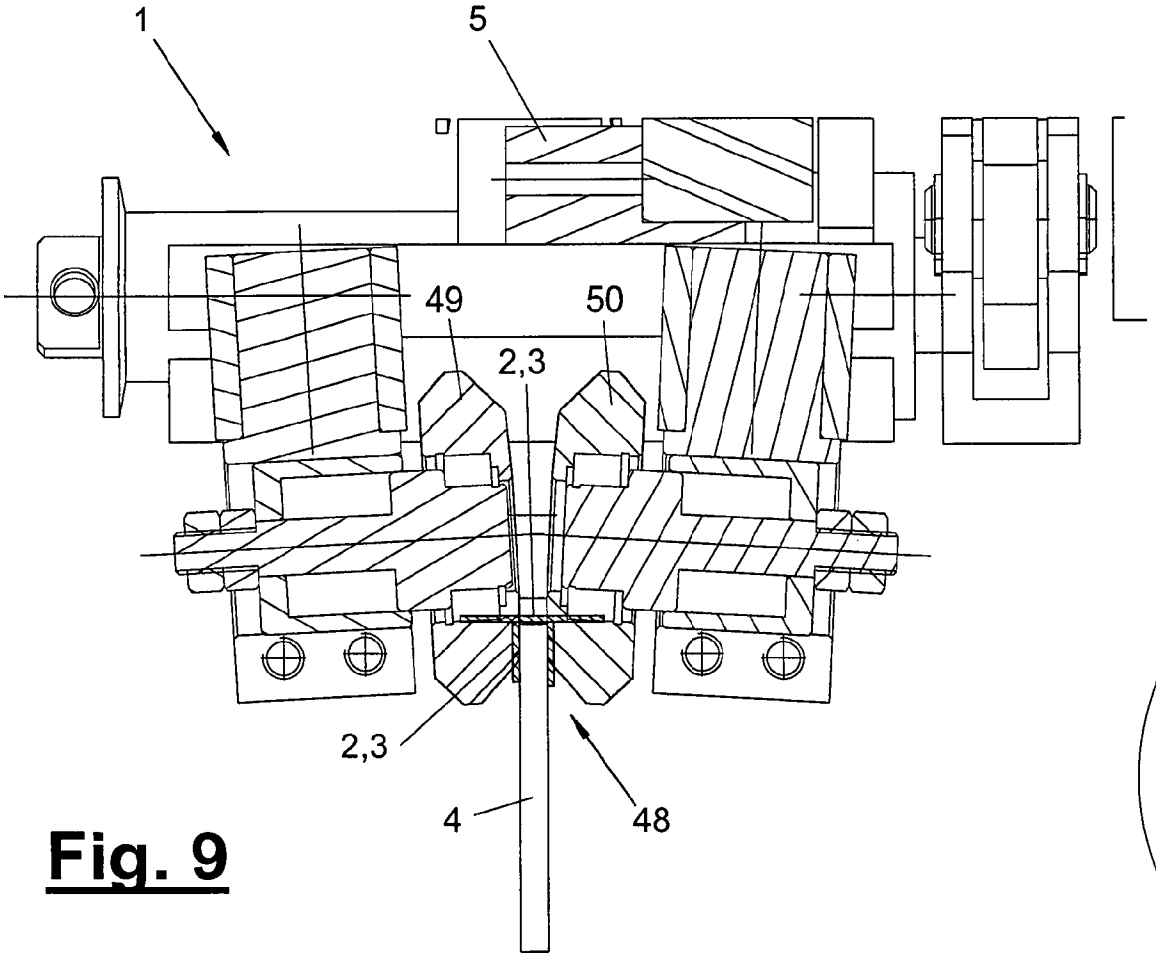
FIG. 9 is a section through a form roller array according to section line IX-IX from FIG. 8.

The cover tape (3) is separated from the adhesive tape (2) at the pressing element (47), which then follows in the direction of feed (23) and which is designed, e.g., as a freely rotatable pressing roller, and it is led upwardly to a deflecting roller (15') and from here further to the dancer (11). FIG. 9 shows this cover tape guiding in a sectional view. Pressing element (47) may be present as a single pressing element or as a plurality of pressing elements. It contacts the cover tape (3) and acts on same from above.

The form roller arrangement (48) shown in a front view in FIG. 8 and in a sectional view in FIG. 9 is used to apply the adhesive tape and possibly also the cover tape (3) on a bent substrate (4). This substrate may have, e.g., the web shape shown in FIG. 10, and the adhesive tape (2) and optionally the cover tape (3) are laid in a U-shaped pattern around the upper edge area of web (4) and pressed on both sides. The tape or tapes (2, 3) now project over the web (4) on both sides.

Form roller arrangement (48) may have one or more, optionally freely rotatable form rollers (49, 50). Two form rollers (49, 50) located at axially spaced locations from one another with prismatic and beveled jacket shapes, which have oblique axes of rotation and assume a V-position in relation to one another, are provided in the embodiment according to FIG. 9, and they form a double conical geometry extending around web (4). Due to the prismatic jacket shape of the form rollers (49, 50), tape (2) or tapes (2, 3) applied at first flatly to the top side of the web is/are folded down and pressed onto the lateral areas of the web edge during the feed of the tape applicator (1). The form rollers (49, 50) set in a V-shaped position bring about a tong-like clamping and pressing closure.

The form roller arrangement (48) may have, as an alternative, only one form roller (49, 50) or more than two form rollers (49, 50). It is possible to operate with a single form roller (49, 50), e.g., when an adhesive tape (2) is to be applied at the corner area of a substrate (4) and is to be bent only at the edge once and, e.g., by 90°. A pressing roller, which presses the adhesive tape (2) located on the top side of the substrate (4) from the top and secures the position of said adhesive tape during the bending of the laterally projecting edge area, may be additionally present now. Any other desired angles are possible for bending in another variant. A possibly multilayer tape (2, 3) may also be adapted to and pressed on a rounded or arched surface of the substrate (4) in a similar manner. The one or more form rollers (49, 50) are provided for this with a correspondingly designed jacket and can have a corresponding axis inclination. Substrate (4) and the adapted form rollers (49, 50) may have any desired bent or arched contour at right angles to the direction of feed (23). The roller jackets may be compression-proof or elastically deformable to a limited extent.

To prevent the adhesive tape (2) from adhering to the form rollers (49, 50), the cover tape (3) can be returned to the adhesive tape (2) in the manner shown in FIG. 8 and cover this in the area of the form roller arrangement (48). As an alternative, the form rollers (49, 50) may consist of an inert and non-adhering material, in which case the cover tape (3) can be pulled off and led away from the form roller arrangement (48) in the manner shown in FIG. 7. In another variant of the embodiment shown, the form rollers (49, 50) can be replaced with other types of moldings, e.g., skids, which are rigid parts of the frame, cranks or the like in another molding arrangement.

The cutting means (38) also has a different design in the second variant of the tape applicator (1) according to FIGS. 7 through 10. The cutting member (39') is designed in this case as a rotating circular or roller blade, which can be set into rotation by means of a driving disk indicated in FIG. 8 via a belt drive and a drive. The circular knife (39') may be arranged obliquely in relation to the adhesive tape (2). The adjusting means (21) may have the same or similar design as in the first variant of the tape applicator (1) according to FIGS. 1 through 6. The other components of the tape applicator (1) may also have the same or similar design as in the first exemplary embodiment.

Various modifications of the embodiments shown and described are possible. The features of both variants may be combined or replaced with one another as desired. The structural details may also be varied further.

The pressing elements (19, 20) may be designed as bent skids and covered with a low-friction material. The compensating element (35) may also be designed as such a skid. The fixing means (30) may be designed as a positive-locking means instead of a non-positive clamping means and equipped, e.g., with a mandrel or with a pin cushion. Furthermore, the arrangement and orientation of the tape guide (14) may be varied as desired. The types and shapes of tapes and especially also the tape width may be varied as well, and the tape guide (14) with the deflecting rollers (15, 16) and with the guide shoe (17) may be converted correspondingly. The design details of the components of the tape applicator (1) described, which can be varied as desired while maintaining their function, are variable as well.

While specific embodiments of the invention have been described in detail to illustrate the application of the principles of the invention, it will be understood that the invention may be embodied otherwise without departing from such principles.

LIST OF REFERENCE NUMBERS

1 Tape applicator
2 Tape, adhesive tape, adhesive tape
3 Tape, cover tape
4 Substrate, web
5 Frame
6 Connection, robot connection
7 Change-over clutch
8 Tape roll, adhesive tape roll
9 Tape roll, cover tape roll
10 Drive
11 Dancer roll
12 Dancer roll
13 Adjusting element, spring
14 Tape guide
15 Deflecting roller
15' Deflecting roller
16 Deflecting roller
17 Guide shoe
18 Pressing device
19 Pressing element, pressing roller in front
20 Pressing element, pressing roller in rear
21 Adjusting means
22 Adjusting carriage
23 Direction of feed
24 Tape loop, cover tape
25 Loop center, arriving
26 Loop center, leaving
27 Take loop opening
28 Tape section, adhesive tape lifted off
29 Tape section, adhesive tape applied
30 Fixing means, clamping means
31 Pressure pad
32 Clamping element
33 Drive
34 Compensating means
35 Compensating element, compensating roller
36 Guide, carriage
37 Adjusting element, spring
38 Cutting means
39 Cutting member, cutting knife, drawing knife
39' Cutting member, circular knife
40 Drive
41 Sensor, camera
42 Sensor, splicing sensor
43 Sliding clutch
44 Guide groove
45 Side wall, guiding
46 Groove bottom
47 Pressing element, additional pressing roller
48 Molding arrangement, form roller array
49 Molding, form roller
50 Molding, form roller

The invention claimed is:

1. A method for applying multilayer tapes, the method comprising the steps of:

providing a tape applicator comprising a multilayer tape with at least one adhesive tape and a cover tape, a frame, a tape roll for the multilayer tape, a tape guide for pulled-off cover tape, a tape guide, a pressing device for pressing the adhesive tape onto a substrate, wherein the pressing device has two pressing elements located at closely spaced locations from one another, said two pressing elements contacting the cover tape;

applying at least the adhesive tape and the cover tape, to the substrate by means of the tape applicator;

separating the cover tape from the adhesive tape in places during application;

leading away the separated cover tape; and cutting through the adhesive tape at the site of separation.

2. A method in accordance with claim 1, wherein the separated cover tape is subsequently returned onto the applied adhesive tape, is pressed on and then removed and moved away again.

3. A method in accordance with claim 1, wherein the applied adhesive tape is caused to adapt to the shape of a contoured substrate.

4. A tape applicator for multilayer tapes, comprising:

a multilayer tape with at least one adhesive tape and a cover tape;

a frame;

a tape roll for the multilayer tape;

a tape guide for pulled-off cover tape;

a tape guide; and a pressing device for pressing the adhesive tape onto a substrate, wherein the pressing device has two pressing elements located at closely spaced locations from one another, said pressing elements contacting the cover tape.

5. A tape applicator in accordance with claim 4, wherein the pressing elements are designed as freely rotatable pressing rollers.

6. A tape applicator in accordance with claim 4, wherein the pressing elements are arranged one after the other in a direction of feed.

7. A tape applicator in accordance with claim 4, wherein the pressing element located in front in a direction of feed has an adjusting means for lifting off the pressing element from the substrate.

8. A tape applicator in accordance with claim 4, further comprising an adjusting means for lifting off one of said pressing elements obliquely upwardly and moving said one of said pressing elements away from the other of said pressing elements.

9. A tape applicator in accordance with claim 4, further comprising a guide shoe inclined in a direction of adjustment and arranged above one of said pressing elements for the adhesive tape and cover tape.

10. A tape applicator in accordance with claim 4, further comprising a tape loop, wherein the cover tape is separated from the adhesive tape between the pressing elements and is led in the tape loop.

11. A tape applicator in accordance with claim 10, further comprising a compensating means arranged at said tape loop.

12. A tape applicator in accordance with claim 11, wherein said compensating means has a compensating element able to yield, in the closed loop end.

13. A tape applicator in accordance with claim 11, wherein said compensating element is designed as a freely rotatable compensating roller.

14. A tape applicator in accordance with claim 11, wherein said compensating means has a guide and an elastic adjusting element for a compensating element.

15. A tape applicator for multiple tapes, comprising:

a multilayer tape with at least one adhesive tape and a cover tape;

a frame;

a tape roll for the multilayer tape;

a tape guide for pulled-off cover tape;

a tape guide; and a pressing device for pressing the adhesive tape onto a substrate, said pressing device having two pressing elements located at closely spaced locations from one another, wherein the cover tape is led around the pressing element located in the rear in the direction of feed at the exit of a tape loop and is arranged between the pressing element and the adhesive tape deposited on the substrate.

16. A tape applicator in accordance with claim 15, wherein the cover tape is led to the tape tape guide for pulled-off cover tape after running around the rear pressing element.

17. A tape applicator in accordance with claim 10, wherein the tape applicator has a cutting means for the adhesive tape.

18. A tape applicator in accordance with claim 17, wherein said cutting means is arranged between the pressing elements.

19. A tape applicator in accordance with claim 17, wherein said cutting means acts on the adhesive tape section being held between the pressing elements in the area of the tape loop opening.

20. A tape applicator in accordance with claim 4, wherein a cutting means has a cutting knife and a drive.

21. A tape applicator in accordance with claim 10, wherein the tape applicator has a fixing means for fixing the cover tape in the area of the tape loop.

22. A tape applicator in accordance with claim 21, wherein a fixing means acts on the tape strand arriving from the front pressing element.

23. A tape applicator in accordance with claim 22, wherein the fixing means is designed as a clamping means and has a stationary pressure pad, a clamping element, which can be fed, and a drive.

24. A tape applicator in accordance with claim 4, further comprising a drive arranged at the tape guide for the pulled-off cover tape.

25. A tape applicator in accordance with claim 4, further comprising a dancer roll with an elastic adjusting element arranged at the tape roll.

26. A tape applicator in accordance with claim 25, wherein the dancer roll controls the drive of the tape roll.

27. A tape applicator in accordance with claim 26, wherein the tape roll for the multilayer tape has a sliding clutch.

28. A tape applicator in accordance with claim 27, further comprising one or more sensors for monitoring the process and the positioning of the tape applicator.

29. A tape applicator in accordance with claim 4, further comprising one or more additional pressing elements for the multilayer tape.

30. A tape applicator in accordance with claim 4, further comprising a molding arrangement for adapting the shape of the adhesive tape applied to a contoured substrate.

* * * * *